US011530790B1

(12) United States Patent
Wu

(10) Patent No.: US 11,530,790 B1
(45) Date of Patent: Dec. 20, 2022

(54) SPACE PROJECTION LAMP

(71) Applicant: Chuanlei Wu, Hainan (CN)

(72) Inventor: Chuanlei Wu, Hainan (CN)

( * ) Notice: Subject to any disclaimer, the term of this patent is extended or adjusted under 35 U.S.C. 154(b) by 0 days.

(21) Appl. No.: 17/674,393

(22) Filed: Feb. 17, 2022

(51) Int. Cl.

| | |
|---|---|
| ***F21S 10/00*** | (2006.01) |
| ***F21V 5/04*** | (2006.01) |
| ***F21V 7/04*** | (2006.01) |
| ***F21S 10/06*** | (2006.01) |

(52) U.S. Cl.
CPC ..... *F21S 10/007* (2013.01); *F21S 10/06* (2013.01); *F21V 5/04* (2013.01); *F21V 7/04* (2013.01)

(58) Field of Classification Search
CPC ..... F21S 10/007; F21S 10/06; F21V 5/04; F21V 7/04; F21V 5/008; F21V 13/04; F21V 7/048; F21V 13/06
See application file for complete search history.

(56) References Cited

U.S. PATENT DOCUMENTS

| | | | | |
|---|---|---|---|---|
| 3,366,786 | A * | 1/1968 | Delano | F21V 9/40 362/280 |
| 4,217,040 | A * | 8/1980 | Longerbeam | G03B 21/00 353/46 |
| 11,215,912 | B1 * | 1/2022 | Xu | F21V 7/048 |
| 2003/0218881 | A1 * | 11/2003 | Hansen | F21S 10/007 362/283 |
| 2019/0132544 | A1 * | 5/2019 | Xi | F21V 14/06 |

* cited by examiner

*Primary Examiner* — Y M. Quach Lee
(74) *Attorney, Agent, or Firm* — Muncy, Geissler, Olds & Lowe, P.C.

(57) ABSTRACT

A space projection lamp includes the convex lens, an uneven reflective plate, motor, light source, integrated main control and power input. The bottom surface of the uneven reflective plate is fixedly connected with the output shaft of the motor. The convex lens and the light source are respectively arranged on both sides of the uneven reflective plate. The light emitted by the light source passes through the convex lens after being reflected by the uneven reflective plate. When the light source irradiates the uneven reflective plate from the side, the reflection is projected out through the imaging of convex lens, forming a layered light effect. When the motor rotates with uneven reflective plate, it will form a multi-level dream light effect.

4 Claims, 10 Drawing Sheets

SPACE PROJECTION LAMP

TECHNICAL FIELD

The invention relates to the field of multiple light-effect projection lamps, in particular to a space projection lamp.

BACKGROUND

With the development of society, people's requirements for living standards are getting higher and higher, and more and more people are beginning to pursue the quality of life. For example, people are beginning to pay attention to lighting lamps, but the current lighting lamps on the market only have the function of lighting, the light elements emitted are single and the lighting atmosphere is monotonous, it is easy to cause visual and aesthetic fatigue for users; with the improvement of quality of life, people have more requirements for lighting atmosphere, lighting lamps that can only emit monotonous lights are far from meeting people's needs, people are beginning to pay attention to lighting lamps that can create a wonderful lighting atmosphere.

In the current industry, there are almost no products that simulate the movement of multiple colored light effects and the stars and planets in space.

Therefore, the technical problem reflected above is an urgent problem to be solved by those skilled in the art.

SUMMARY OF THE INVENTION

The object of the invention is to provide a space projection lamp, which simulates the movement of various colored lights and stars and planets or other patterns in space, restores the effect of beautiful space, and makes up for the dream of vast space that the current lighting lamps lack and the blank of the combination of projection and imaging.

In order to achieve the above objects, the following technical schemes are adopted: a space projection lamp comprises the convex lens, uneven reflective lens, reflective motor, reflective light source, integrated main control and power input;

the bottom surface of the uneven reflective lens is fixedly connected with the output shaft of the reflective motor, the convex lens and the reflective light source are respectively arranged on both sides of the uneven reflective lens, and the light emitted by the reflective light source passes through the convex lens after being reflected by the uneven reflective lens, the power input is electrically connected to the input end of the integrated main control, and the reflective motor and the reflective light source are electrically connected to the output end of the integrated main control.

As an improvement, the space projection lamp also comprises a condenser lens, the condenser lens is arranged at the front end of the reflective light source, the light emitted by the reflective light source passes through the condenser lens and is reflected by the uneven reflective lens through the convex lens.

As an improvement, the space projection lamp also comprises a laser light source and an astigmatism sheet, the laser light source emits laser light through the astigmatism sheet, the laser light source is electrically connected to the output end of the integrated main control.

As an improvement, the space projection lamp also comprises an LED light source, a pattern sheet, a pattern motor, a first pattern lens, a second pattern lens, and a third pattern lens, the LED light source, the first pattern lens, the pattern sheet, the second pattern lens and the third pattern lens are arranged in order, the bottom surface of the pattern sheet is fixedly connected with the the output shaft of pattern motor, and the LED light source and the pattern motor are electrically connected with the output terminal of the integrated main control.

As an improvement, the space projection lamp also comprises an astigmatism motor, the bottom surface of the astigmatism sheet is fixedly connected with the output shaft of the astigmatism motor, and the astigmatism motor is electrically connected with the output end of the integrated main control.

As an improvement, the space projection lamp also comprises an LED light source, a pattern sheet, a pattern motor, a first pattern lens, a second pattern lens, and a third pattern lens, the LED light source, the first pattern lens, the pattern sheet, the second pattern lens and the third pattern lens are arranged in order, the bottom surface of the pattern sheet is fixedly connected with the output shaft of the pattern motor, and the LED light source and the pattern motor are electrically connected with the output terminal of the integrated main control.

As an improvement, the space projection lamp also comprises a laser light source and an astigmatism sheet, the laser light source emits laser light through the astigmatism sheet, the laser light source is electrically connected to the output end of the integrated main control.

As an improvement, the space projection lamp also comprises an LED light source, a pattern sheet, a pattern motor, a first pattern lens, a second pattern lens, and a third pattern lens, the LED light source, the first pattern lens, the pattern sheet, the second pattern lens and the third pattern lens are arranged in order, the bottom surface of the pattern sheet is fixedly connected with the output shaft of the pattern motor, and the LED light source and the pattern motor are electrically connected with the output terminal of the integrated main control.

As an improvement, the space projection lamp also comprises an astigmatism motor, the bottom surface of the astigmatism sheet is fixedly connected with the output shaft of the astigmatism motor, and the astigmatism motor is electrically connected with the output end of the integrated main control.

As an improvement, the space projection lamp also comprises an LED light source, a pattern sheet, a pattern motor, a first pattern lens, a second pattern lens, and a third pattern lens, the LED light source, the first pattern lens, the pattern sheet, the second pattern lens and the third pattern lens are arranged in order, the bottom surface of the pattern sheet is fixedly connected with the output shaft of the pattern motor, and the LED light source and the pattern motor are electrically connected with the output terminal of the integrated main control.

The advantages of the invention compared with the prior art are as follows: when the light source irradiates the uneven reflective lens from the side, the reflection is projected out through the imaging of convex lens, forming a layered light effect, when the motor rotates with uneven reflective lens, it will form a multi-level dream light effect. The principle of reflective production can reduce the loss of the light source and the production space, this production method is to reduce the cost of investment, increase the value of the product, and add the best space projection experience to life.

Figure 1:
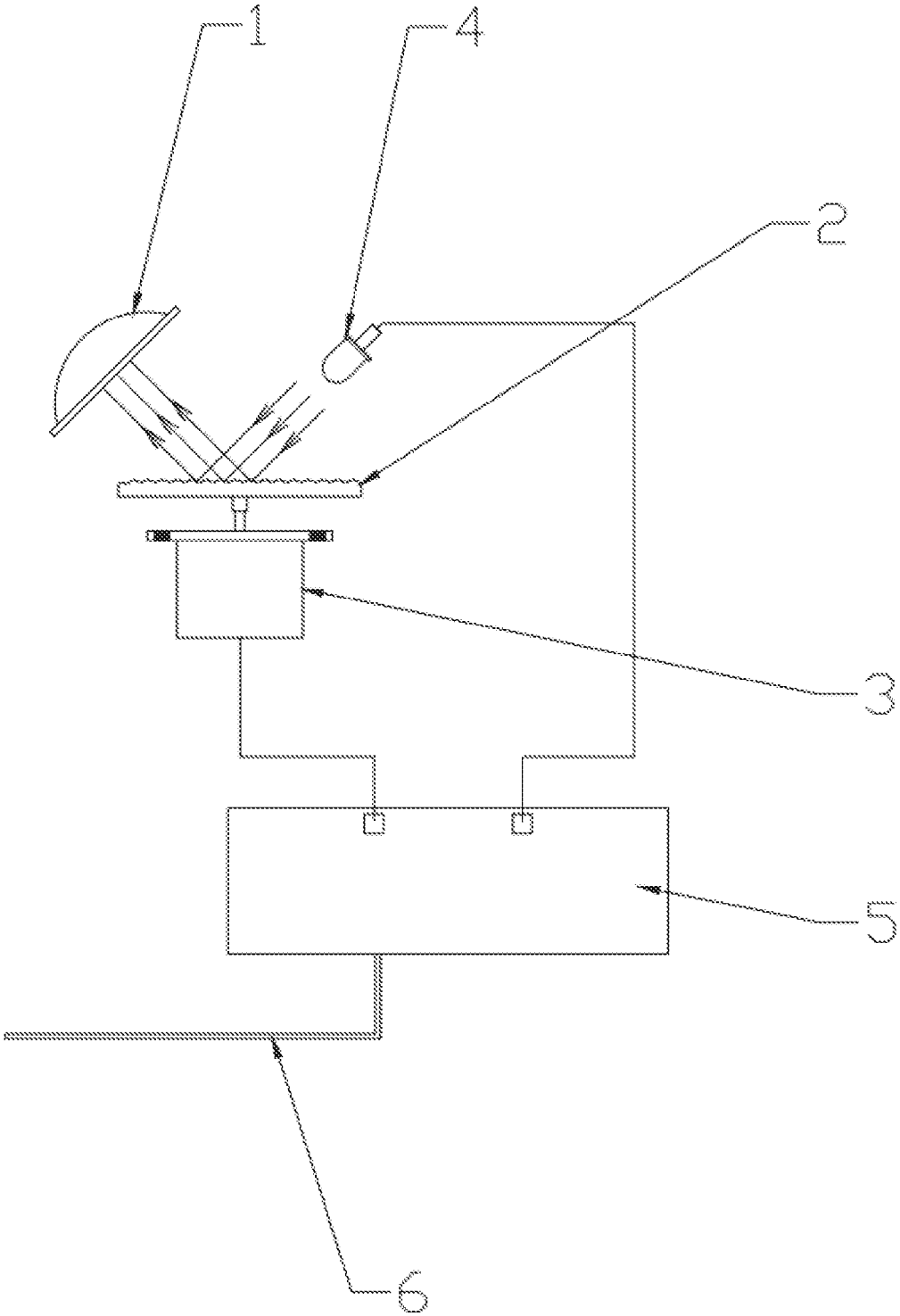
FIG. 1 is a schematic diagram of the space projection lamp provided in embodiment 1 of the invention.

As shown in the figure, 1 refers to the convex lens, 2 refers to the uneven reflective lens, 3 refers to the reflective motor, 4 refers to the reflective light source, 5 refers to the integrated main control, 6 refers to the power input, 7 refers to the condenser lens, 8 refers to the laser light source, 9 refers to the astigmatism sheet, 10 refers to the LED light source, 11 refers to the pattern sheet, 12 refers to the pattern motor, 13 refers to the first pattern lens, 14 refers to the second pattern lens, 15 refers to the third pattern lens, 16 refers to the astigmatism motor.

DESCRIPTION OF EMBODIMENTS

The embodiments of the invention will be described in detail below, examples of the embodiments are shown in the drawings, wherein the same or similar reference numerals indicate the same or similar elements or elements with the same or similar functions. In the description of the invention, it should be understood that the orientation or position relations indicated by the terms "upper", "lower", "front", "rear", "left", "right", "inner", "outer", "vertical", "peripheral" are based on the orientation or positional relations shown in the drawings, and are only for the convenience of describing the invention and simplifying the description, rather than indicating or implying that the device or component referred to must have a specific orientation and be constructed and operated in a specific orientation, and therefore cannot be understood as a limitation of the invention.

Embodiment 1

Combined with FIG. 1, a space projection lamp comprises the convex lens 1, uneven reflective lens 2, reflective motor 3, reflective light source 4, integrated main control 5 and power input 6; the bottom surface of the uneven reflective lens 2 is fixedly connected with the output shaft of the reflective motor 3, the convex lens 1 and the reflective light source 4 are respectively arranged on both sides of the uneven reflective lens 2, and the light emitted by the reflective light source 4 passes through the convex lens 1 after being reflected by the uneven reflective lens 2, the power input 6 is electrically connected to the input end of the integrated main control 5, and the reflective motor 3 and the reflective light source 4 are electrically connected to the output end of the integrated main control 5.

During the operation of this embodiment, the light source irradiates the uneven reflective lens from the side, the reflection is projected out through the imaging of convex lens 1, forming a layered light effect, when the motor rotates with uneven reflective lens, it will form a multi-level dream light effect. The principle of reflective production can reduce the loss of the light source and the production space, this production method is to reduce the cost of investment, increase the value of the product, and add the best space projection experience to life.

Embodiment 2

Figure 2:
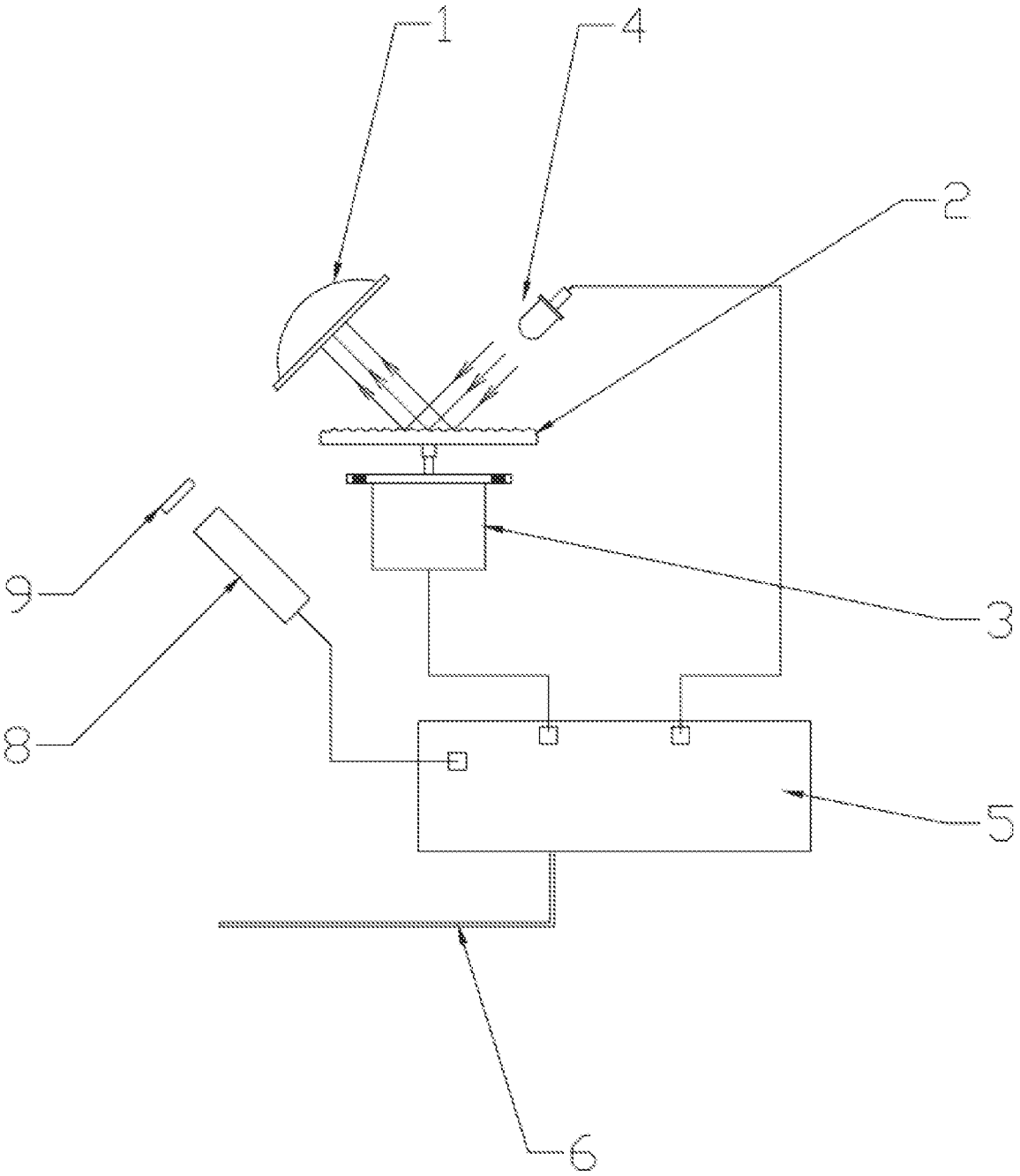
FIG. 2 is a schematic diagram of the space projection lamp provided in embodiment 2 of the invention.

Combined with FIG. 2, a space projection lamp comprises the convex lens 1, uneven reflective lens 2, reflective motor 3, reflective light source 4, integrated main control 5 and power input 6; the bottom surface of the uneven reflective lens 2 is fixedly connected with the output shaft of the reflective motor 3, the convex lens 1 and the reflective light source 4 are respectively arranged on both sides of the uneven reflective lens 2, and the light emitted by the reflective light source 4 passes through the convex lens 1 after being reflected by the uneven reflective lens 2, the power input 6 is electrically connected to the input end of the integrated main control 5, and the reflective motor 3 and the reflective light source 4 are electrically connected to the output end of the integrated main control 5.

Further, the space projection lamp also comprises a laser light source 8 and an astigmatism sheet 9, the laser light source 8 emits laser light through the astigmatism sheet 9, the laser light source 8 is electrically connected to the output end of the integrated main control 5.

The difference between this embodiment and embodiment 1 is that after the laser light source 8 emits light, when passing through the astigmatism sheet 9, the light will split into countless large and small spots, simulating the effect of the distance of stars in space.

Embodiment 3

Figure 3:
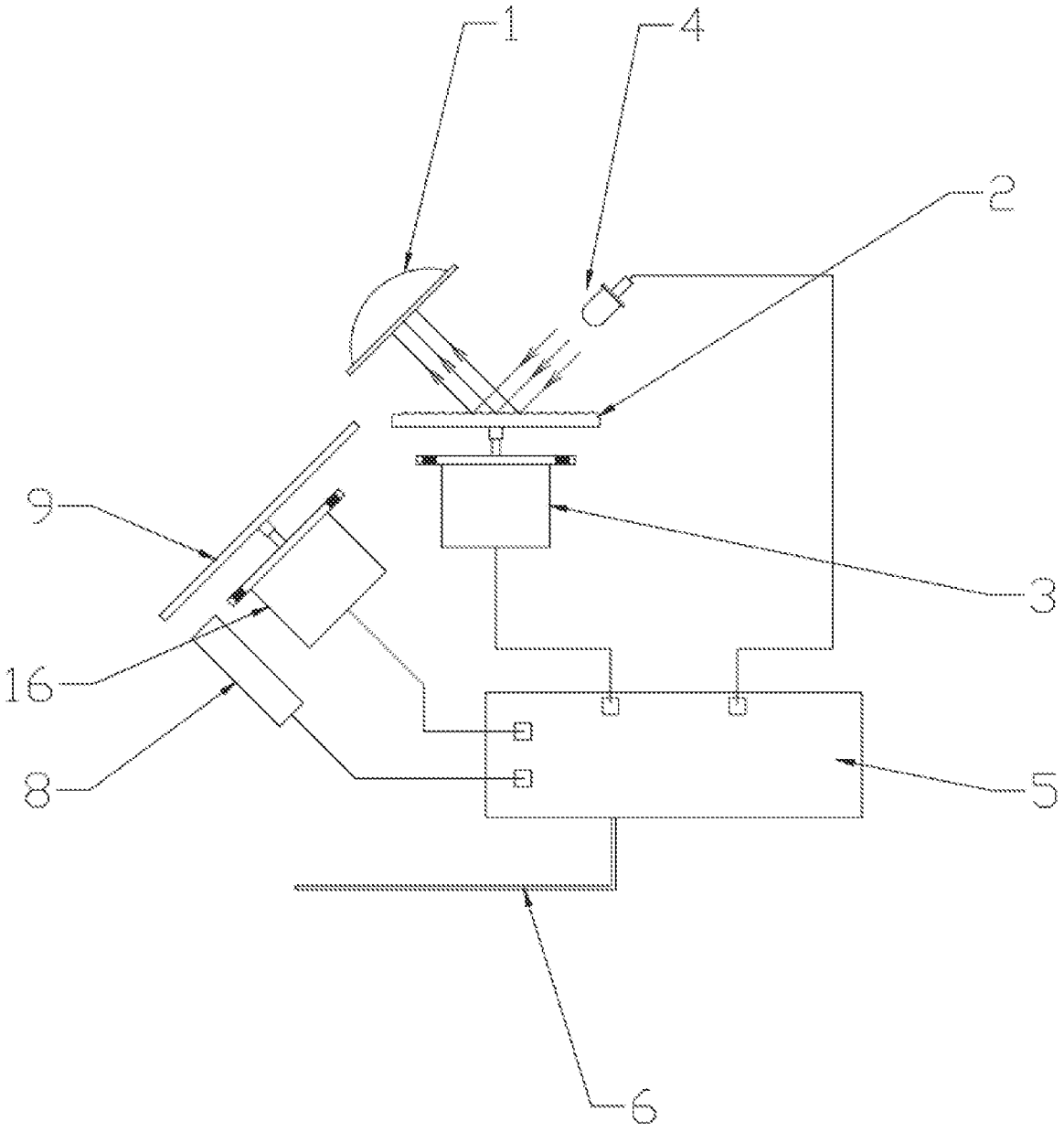
FIG. 3 is a schematic diagram of the space projection lamp provided in embodiment 3 of the invention.

Combined with FIG. 3, a space projection lamp comprises the convex lens 1, uneven reflective lens 2, reflective motor 3, reflective light source 4, integrated main control 5 and power input 6; the bottom surface of the uneven reflective lens 2 is fixedly connected with the output shaft of the reflective motor 3, the convex lens 1 and the reflective light source 4 are respectively arranged on both sides of the uneven reflective lens 2, and the light emitted by the reflective light source 4 passes through the convex lens 1 after being reflected by the uneven reflective lens 2, the power input 6 is electrically connected to the input end of the integrated main control 5, and the reflective motor 3 and the reflective light source 4 are electrically connected to the output end of the integrated main control 5.

Further, the space projection lamp also comprises a laser light source 8 and an astigmatism sheet 9, the laser light source 8 emits laser light through the astigmatism sheet 9, the laser light source 8 is electrically connected to the output end of the integrated main control 5.

Further, the space projection lamp also comprises an astigmatism motor 16, the bottom surface of the astigmatism sheet 9 is fixedly connected with the output shaft of the astigmatism motor 16, and the astigmatism motor 16 is electrically connected with the output end of the integrated main control 5.

The difference between this embodiment and embodiment 2 is that after the laser light source 8 emits light, when passing through the astigmatism sheet 9, the light will split into countless large and small spots, simulating the effect of the distance of stars in space, when the astigmatism motor 16 rotates with the astigmatism sheet 9, it will form a dynamic effect of astigmatism.

Embodiment 4

Figure 4:
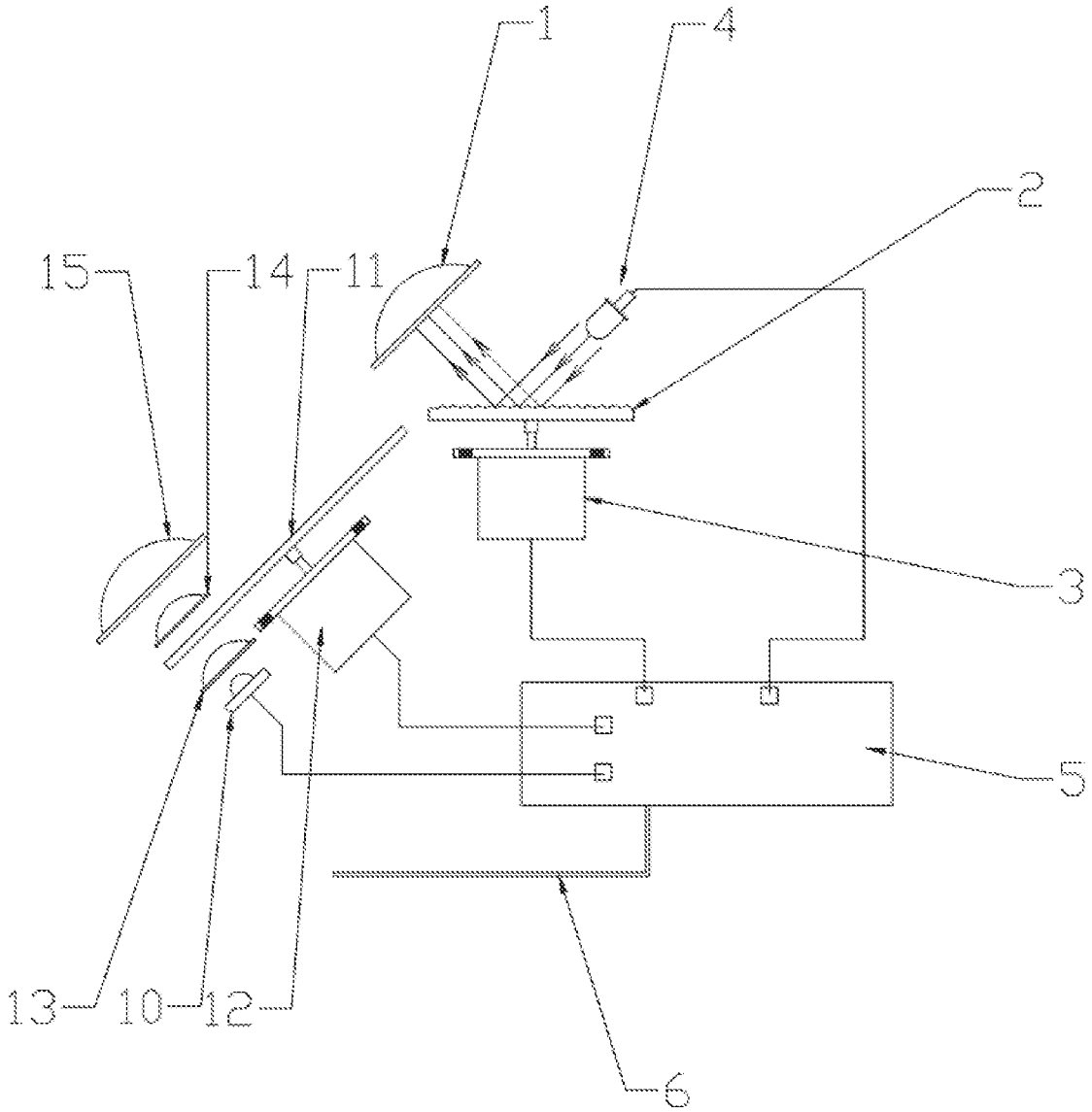
FIG. 4 is a schematic diagram of the space projection lamp provided in embodiment 4 of the invention.

Combined with FIG. 4, a space projection lamp comprises the convex lens 1, uneven reflective lens 2, reflective motor 3, reflective light source 4, integrated main control 5 and power input 6; the bottom surface of the uneven reflective lens 2 is fixedly connected with the output shaft of the reflective motor 3, the convex lens 1 and the reflective light source 4 are respectively arranged on both sides of the uneven reflective lens 2, and the light emitted by the reflective light source 4 passes through the convex lens 1 after being reflected by the uneven reflective lens 2, the power input 6 is electrically connected to the input end of the integrated main control 5, and the reflective motor 3 and the reflective light source 4 are electrically connected to the output end of the integrated main control 5.

Further, the space projection lamp also comprises an LED light source 10, a pattern sheet 11, a pattern motor 12, a first pattern lens 13, a second pattern lens 14, and a third pattern lens 15, the LED light source 10, the first pattern lens 13, the pattern sheet 11, the second pattern lens 14 and the third pattern lens 15 are arranged in order, the bottom surface of the pattern sheet 11 is fixedly connected with the the output shaft of pattern motor 12, and the LED light source 10 and the pattern motor 12 are electrically connected with the output terminal of the integrated main control 5.

The difference between this embodiment and embodiment 1 is that the LED light source 10 emits light through the first pattern lens 13, images the pattern sheet 11, and then passes through the second pattern lens 14 and the third pattern lens 15 to form a moon or other patterns, the moon or other patterns are projected to simulate the imaging of the moon or other patterns in the sky, when the pattern motor 12 rotates with the pattern sheet 11, a dynamic pattern effect will be formed.

Embodiment 5

Figure 5:
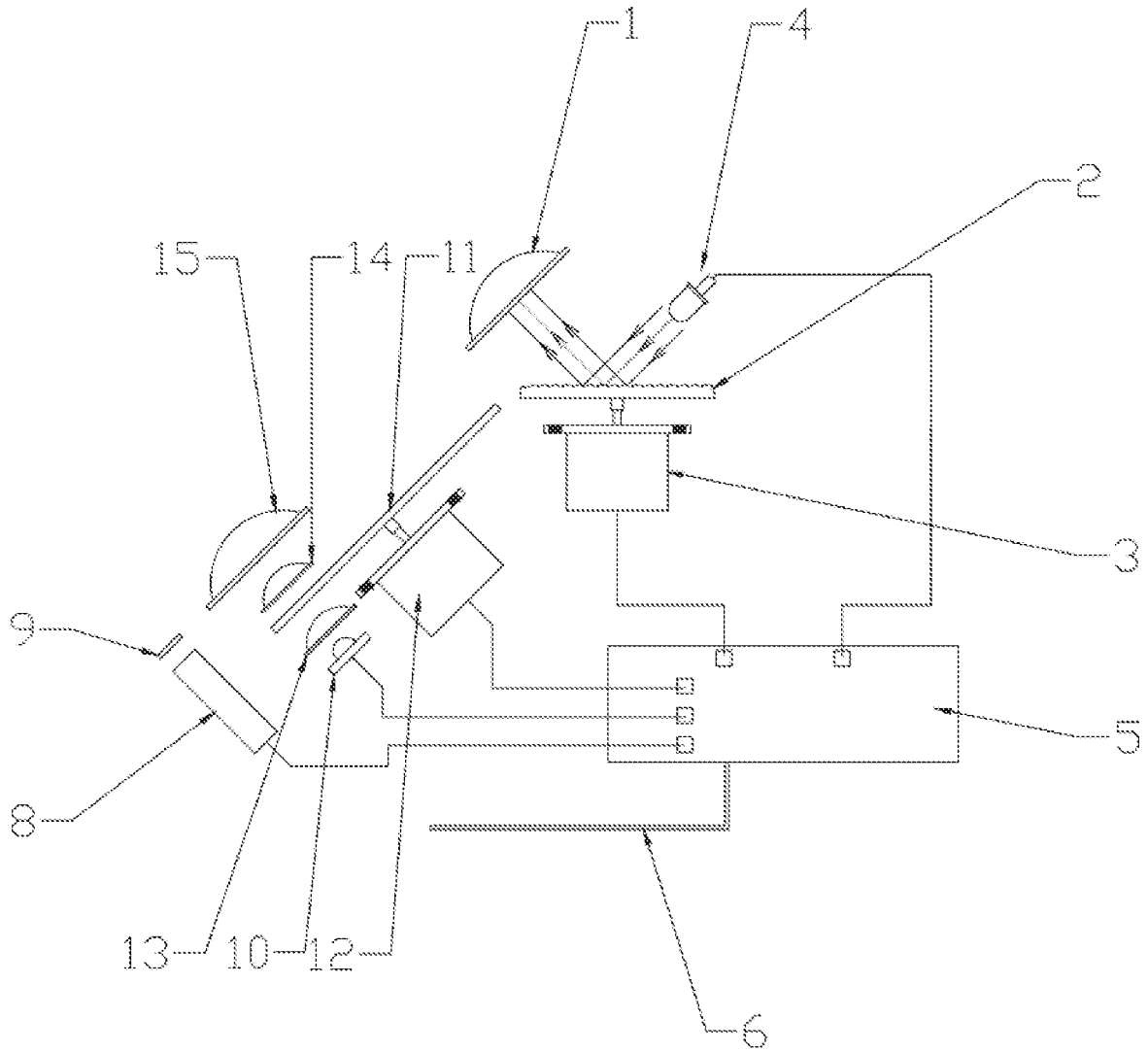
FIG. 5 is a schematic diagram of the space projection lamp provided in embodiment 5 of the invention.

Combined with FIG. 5, embodiment 5 can be formed by combining embodiment 2 and embodiment 4. Embodiment 5 can not only simulate the effect of the distance of stars in space, but also simulate the imaging of the moon or other patterns in the sky.

Embodiment 6

Figure 6:
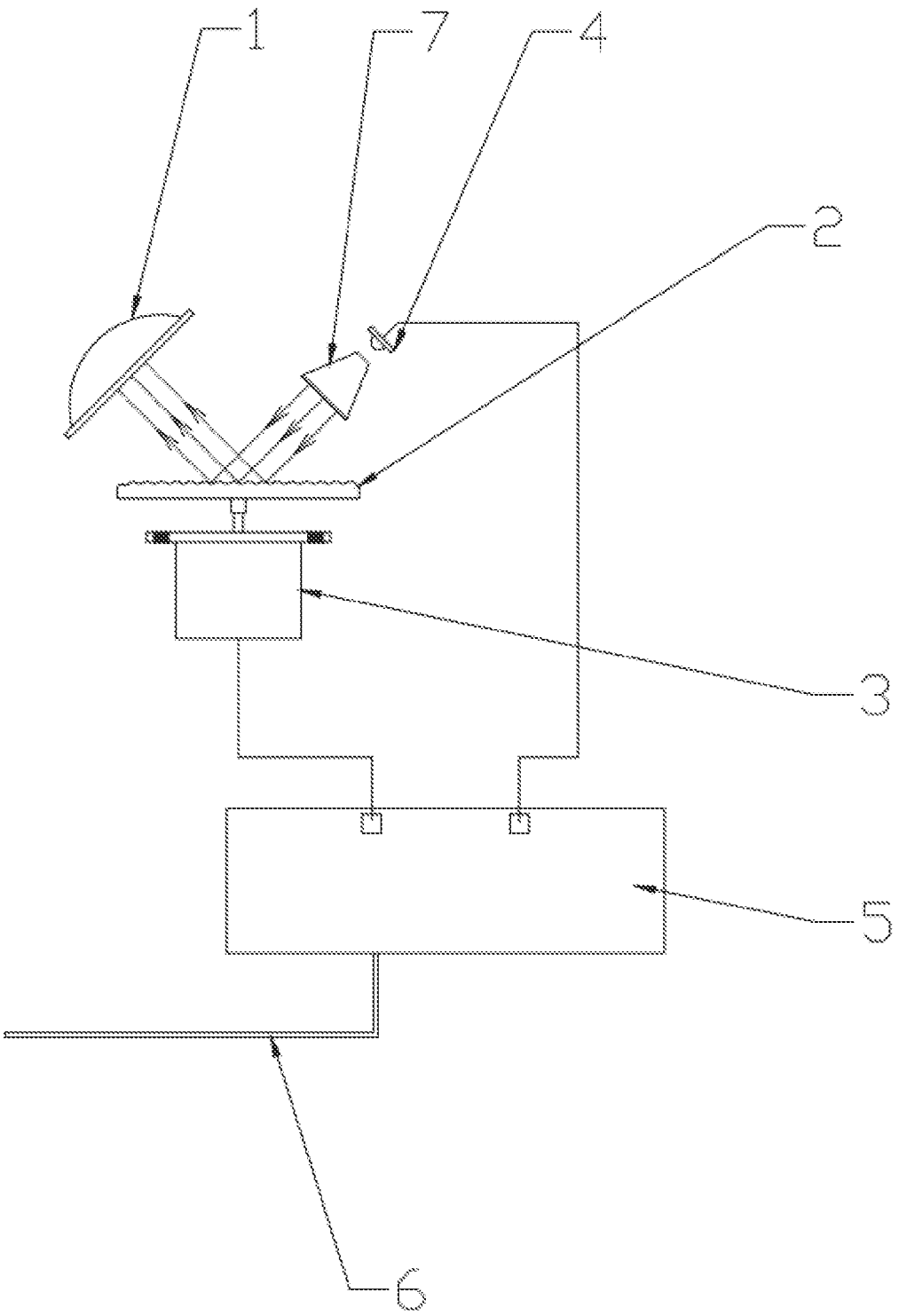
FIG. 6 is a schematic diagram of the space projection lamp provided in embodiment 6 of the invention.

Combined with FIG. 6, a space projection lamp comprises the convex lens 1, uneven reflective lens 2, reflective motor 3, reflective light source 4, integrated main control 5 and power input 6; the bottom surface of the uneven reflective lens 2 is fixedly connected with the output shaft of the reflective motor 3, the convex lens 1 and the reflective light source 4 are respectively arranged on both sides of the uneven reflective lens 2, and the light emitted by the reflective light source 4 passes through the convex lens 1 after being reflected by the uneven reflective lens 2, the power input 6 is electrically connected to the input end of the integrated main control 5, and the reflective motor 3 and the reflective light source 4 are electrically connected to the output end of the integrated main control 5.

Further, the space projection lamp comprises a condenser lens 7, the condenser lens 7 is arranged at the front end of the reflective light source 4, the light emitted by the reflective light source 4 passes through the condenser lens 7 and is reflected by the uneven reflective lens 2 through the convex lens 1.

The difference between this embodiment and embodiment 1 is that a condenser lens 7 is added to further focus the light and reduce the loss of the light source.

Embodiment 7

Figure 7:
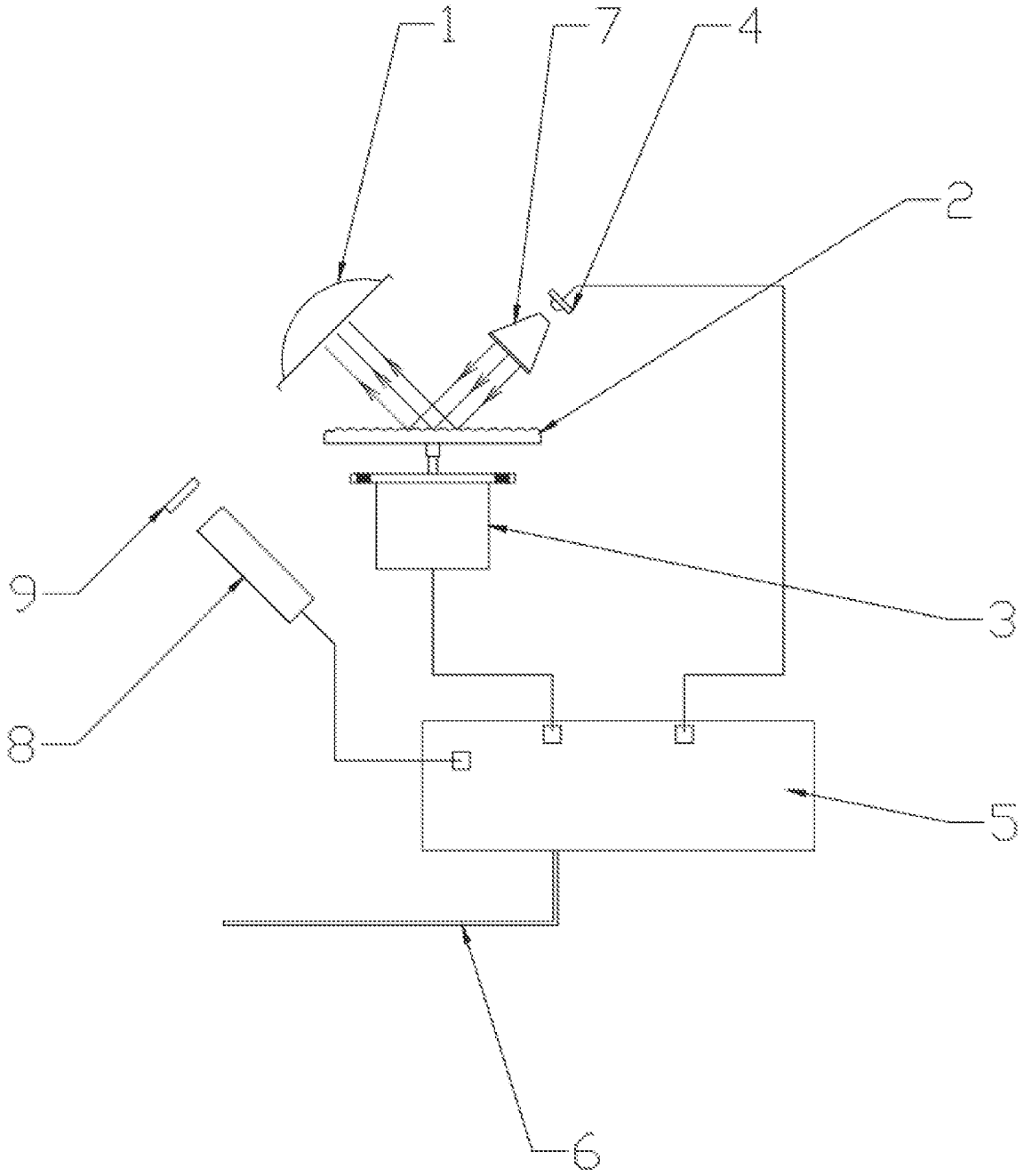
FIG. 7 is a schematic diagram of the space projection lamp provided in embodiment 7 of the invention.

Combined with FIG. 7, embodiment 7 can be formed by combining embodiment 2 with embodiment 6.

The difference between this embodiment and embodiment 1 is that a condenser lens 7 is added to further focus the light and reduce the loss of the light source. In addition, after the laser light source 8 emits light, when it passes through the astigmatism sheet 9, the light will split into numerous large and small light spots, simulating the effect of the distance of stars in space.

Embodiment 8

Figure 8:
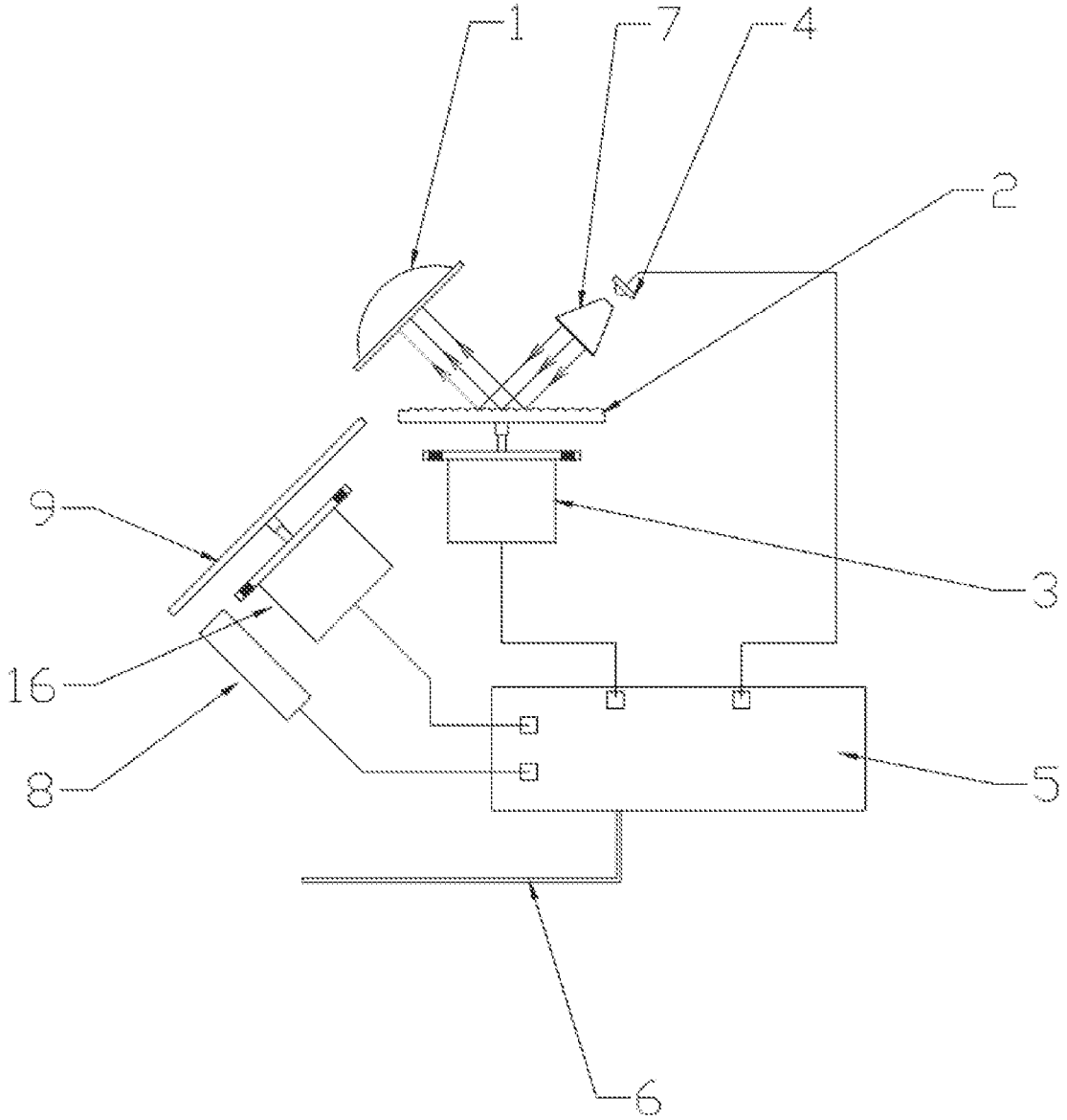
FIG. 8 is a schematic diagram of the space projection lamp provided in embodiment 8 of the invention.

Combined with FIG. 8, embodiment 8 can be formed by combining embodiment 3 with embodiment 6.

The difference between this embodiment and embodiment 1 is that a condenser lens 7 is added to further focus the light and reduce the loss of the light source. After the laser light source 8 emits light, when it passes through the astigmatism sheet 9, the light will split into countless large and small light spots, simulating the effect of the distance of stars in space, when the astigmatism motor 16 rotates with the astigmatism sheet 9, a dynamic effect of astigmatism will be formed.

Embodiment 9

Figure 9:
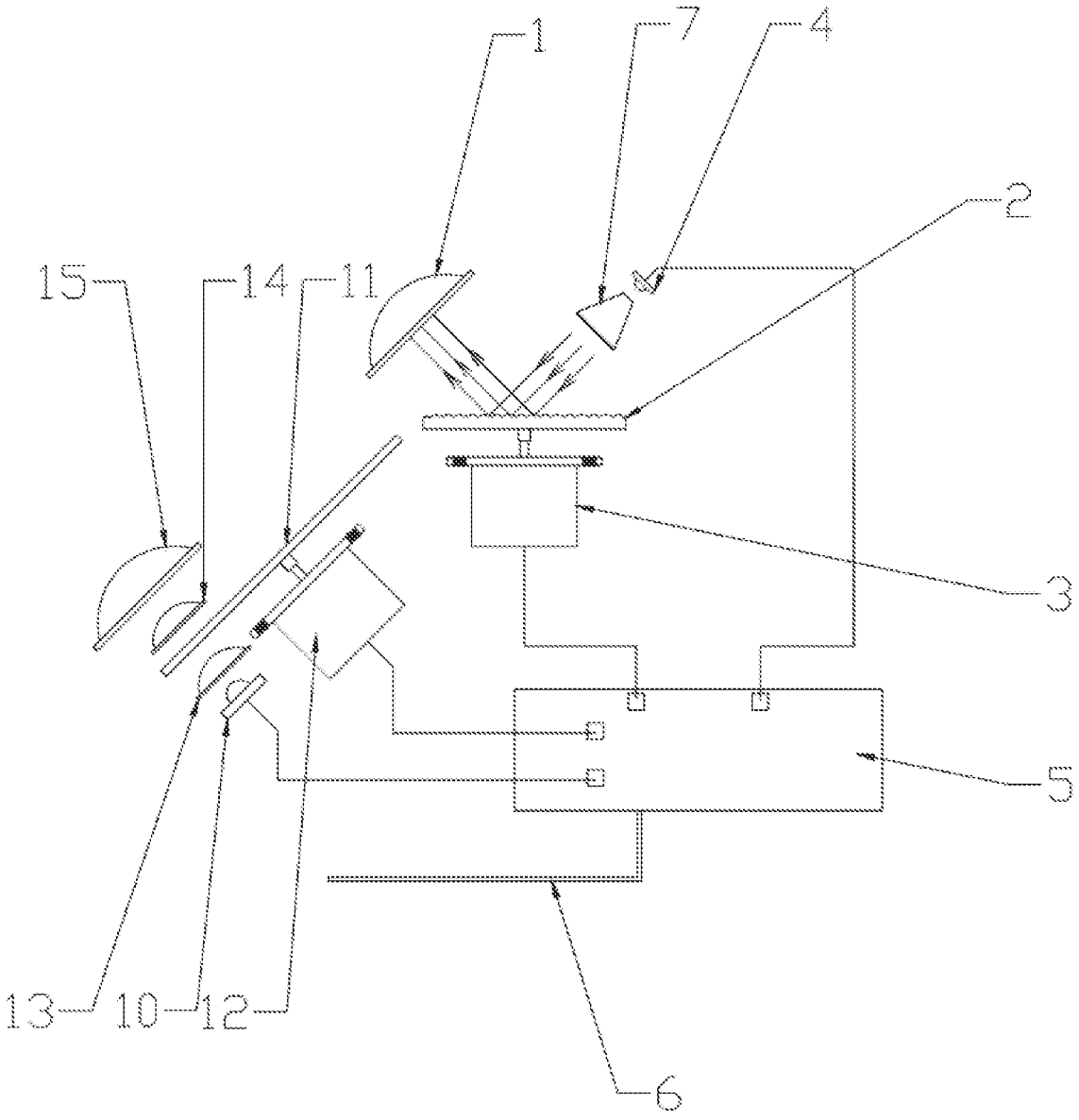
FIG. 9 is a schematic diagram of the space projection lamp provided in embodiment 9 of the invention.

Combined with FIG. 9, embodiment 9 can be formed by combining embodiment 4 with embodiment 6.

The difference between this embodiment and embodiment 1 is that a condenser lens 7 is added to further focus the light and reduce the loss of the light source. The LED light source 10 emits light through the first pattern lens 13, images the pattern sheet 11, and then passes through the second pattern lens 14 and the third pattern lens 15 to form a moon or other patterns, the moon or other patterns are projected to simulate the imaging of the moon or other patterns in the sky, when the pattern motor 12 rotates with the pattern sheet 11, a dynamic pattern effect will be formed.

Embodiment 10

Figure 10:
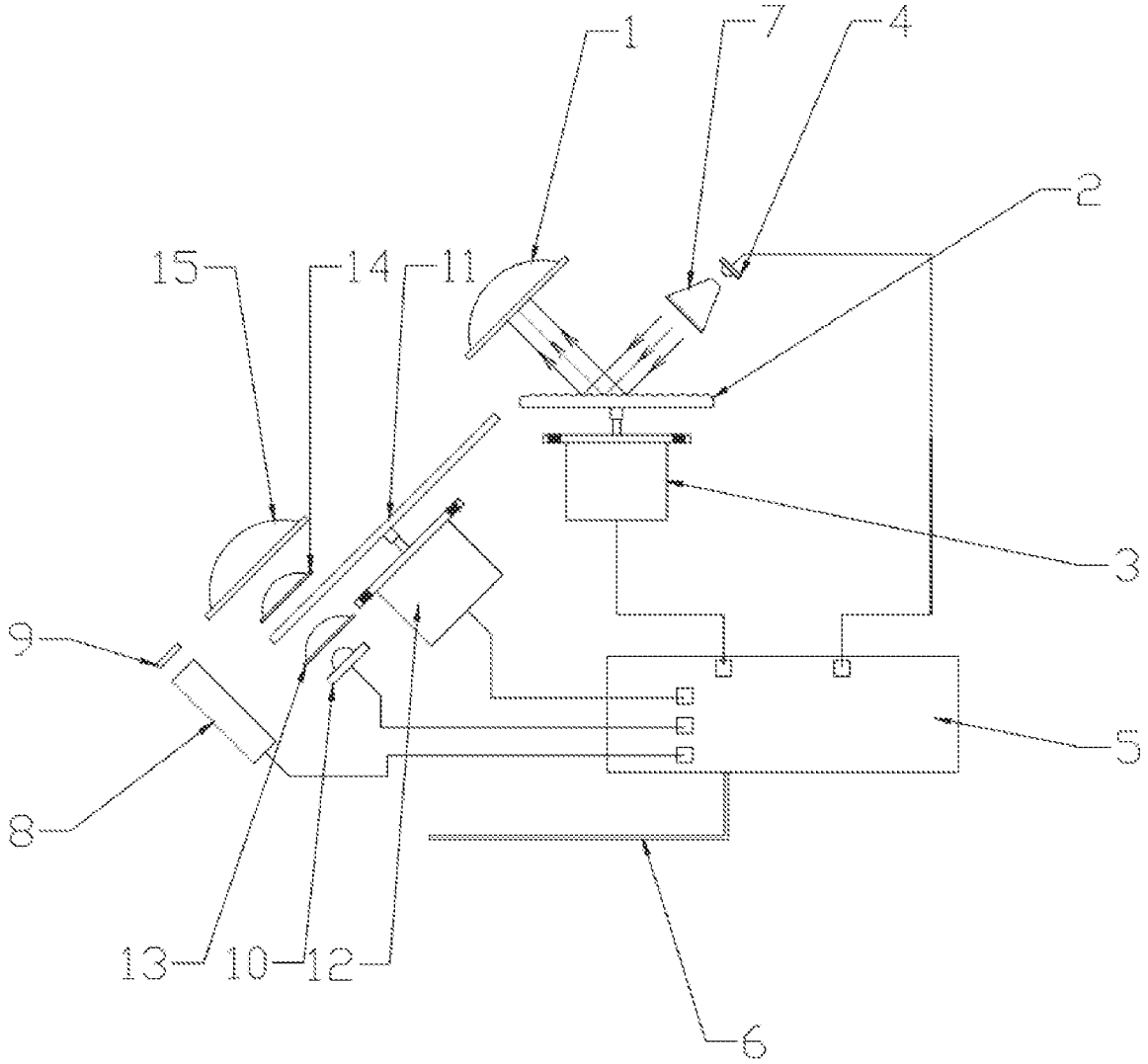
FIG. 10 is a schematic diagram of the space projection lamp provided in embodiment 10 of the invention.

Combined with FIG. 10, embodiment 10 can be formed by combining embodiment 5 with embodiment 6.

The difference between this embodiment and embodiment 1 is that a condenser lens 7 is added to further focus the light and reduce the loss of the light source. This embodiment can not only simulate the effect of the distance of stars in space, but also simulate the imaging of the moon or other patterns in the sky.

The invention and its embodiments are described above, and this description is not restrictive. What is shown in the drawings is only one of the embodiments of the invention, and the actual structure is not limited to this. All in all, if those skilled in the art receives its enlightenment, without deviating from the object of the invention, and without creatively designing structures and embodiments similar to the technical scheme of the invention shall fall within the protection scope of the invention.

The invention claimed is:

1. A space projection lamp comprises convex lens, an uneven reflective plate, a first motor, a light source, an integrated main control, a power input, a laser light source and an astigmatism sheet;

wherein a bottom surface of the uneven reflective plate is fixedly connected with an output shaft of the first motor, the convex lens and the light source are respectively arranged on both sides of the uneven reflective plate, and the light emitted by the light source passes through the convex lens to project an image after being reflected by the uneven reflective plate, the power input is electrically connected to an input end of the integrated main control, and the first motor and the light source are electrically connected to an output end of the integrated main control;

wherein the laser light source emits laser light through the astigmatism sheet to split the laser light on the image projected through the convex lens, the laser light source is electrically connected to the output end of the integrated main control.

2. The space projection lamp according to claim 1, comprising a condenser lens, the condenser lens is arranged at a front end of the light source, the light emitted by the light source passes through the condenser lens and is reflected by the uneven reflective plate through the convex lens.

3. The space projection lamp according to claim 1, comprising an LED light source, a pattern sheet, a second motor, a first pattern lens, a second pattern lens, and a third pattern lens, the LED light source, the first pattern lens, the pattern sheet, the second pattern lens and the third pattern lens are arranged in order, a bottom surface of the pattern sheet is fixedly connected with an output shaft of second motor, and the LED light source and the second motor are electrically connected with the output end of the integrated main control.

4. The space projection lamp according to claim 1, comprising a third motor, a bottom surface of the astigmatism sheet is fixedly connected with an output shaft of the third motor, and the third motor is electrically connected with the output end of the integrated main control.

* * * * *